US005926866A

United States Patent [19]

Chao

[11] Patent Number: 5,926,866

[45] Date of Patent: Jul. 27, 1999

[54] MOVABLE BATHTUB FOR A BABY

[76] Inventor: Ming-Hui Chao, No. 158, Chiuying, Chiuying Li, Yenshui Chen, Tainan Hsien, Taiwan

[21] Appl. No.: 09/129,770

[22] Filed: Aug. 6, 1998

[30] Foreign Application Priority Data

Aug. 19, 1997 [TW] Taiwan ..... 86214059

[51] Int. Cl.[6] ..... A47K 3/022

[52] U.S. Cl. ..... 4/572.1; 4/630; 4/573.1; 4/575.1; 4/584

[58] Field of Search ..... 4/559, 560.1, 572.1, 4/571.1, 573.1, 575.1, 584, 589, 630, 659

[56] References Cited

U.S. PATENT DOCUMENTS

| | | | |
|---|---|---|---|
| 1,409,330 | 3/1922 | Aper | 4/630 |
| 1,726,753 | 9/1929 | Mirkin | 4/572.1 |
| 1,758,071 | 5/1930 | Bleustein | 4/572.1 |
| 2,491,223 | 12/1949 | Stadlman | 4/572.1 |
| 4,881,281 | 11/1989 | Lavoine et al. | 4/572.1 |
| 5,181,284 | 1/1993 | Raphael et al. | 4/573.1 |
| 5,465,438 | 11/1995 | Allman et al. | 4/630 |

*Primary Examiner*—David J. Walczak
*Assistant Examiner*—Khoa Huynh
*Attorney, Agent, or Firm*—Rosenberg, Klein & Bilker

[57] ABSTRACT

A movable bathtub for a baby. The movable bathtub comprises a body and a plurality of wheels on the bottom of the body so as to move the bathtub. The body is separated into a bathing space and a storage space by a separator. The bathing space is placed with a curve-shaped supporting net in one end of which a tub drain and a tub stopper are provided. The storage space is provided with a water-pot in a front end thereof and several drawers in the back end thereof. With the structure of the invention, a parent can pour heated water to the bathtub and bath a baby while standing.

8 Claims, 8 Drawing Sheets

MOVABLE BATHTUB FOR A BABY

BACKGROUND OF THE INVENTION

1. Field of the Invention

The invention relates to a bathtub, and particularly to a movable bathtub for a baby, which provides a most relaxed manner to bath a baby and to dress the baby thereon after bathing.

2. Description of Related Art

Soon after being born, a baby's muscles are not strong enough to support its body, so it is very important for a parent to carefully hold the baby especially when the baby is having a bath. When the baby is taking a bath, the parent must hold the baby with one arm and bath it with the other, so that the baby is protected and water is prevented from flowing into the baby's ears, eyes, nose or mouth. Accordingly, an ergonomic bathtub is introduced to allow a baby to lie on its back when taking a bath.

However, the improvement of this bathtub is to let the baby lie on its back within the bathtub more comfortably. When the baby is taking a bath in the winter, parents have to move the bathtub to a bedroom provided with heating so as to prevent the baby from catching a cold. Although moving the bathtub to the bedroom is quite helpful to the baby's health, it is very troublesome to the parent. The parent is required to carry heated water from a bathroom to the bedroom and to pour it into the bathtub in the heating bedroom. The parent is also required to place necessities, such as soap, towel, clean clothes, etc., in proper locations near the tub. After the bath, the parent must rapidly place the baby on a dry towel and then dress the baby on clean clothes. The bathtub in the heating bedroom is carried out to a bathroom in order to pour the water out of the bathtub, which adds more trouble to the parent(s).

The main disadvantage is that the preparation for bathing and clean up afterward is very complex. The parent must move the bathtub into and out of the bedroom when preparing a bath for a baby. If the parent is careless, the water will be probably spilled on the floor, which will increase the difficulty with clean up.

A second disadvantage is that the bathtub has no fixed locations to store bathing necessities, such as soap, shampoo and many others. They are placed on the edge of the bathtub or on a bed or even on the floor, which is very inconvenient for the parent.

Another disadvantage is that the baby probably catches a cold after a bath. After being bathed, the baby is taken from the bathtub and placed in a dry place to be dressed. During this period of time, it is much possible for the baby to catch a cold if the duration is too long.

SUMMARY OF THE INVENTION

To solve the above-mentioned problems, the invention provides a movable bathtub in which bathing necessities can be stored in fixed locations. The movable bathtub comprises a body and a plurality of wheels on the bottom of the body to move the bathtub. The body is separated into a bathing space and a storage space by a separator. The bathing space is provided with a curve-shaped supporting net in one side in which a tub drain and a tub stopper are provided. The storage space is provided with a water-pot in a front end thereof, which corresponds to the tub drain, and several drawers in the back end thereof.

When the parent is giving a bath to a baby, the parent will move the movable bathtub to a bathroom to pour water into the tub. Then the parent moves the movable bathtub to a bedroom and places the bathing necessities into the proper locations thereof. After bathing, the water in the bathing space is drained from the water-pot via the tub drain. The baby is dried and dressed on the supporting net. The entire process of bathing is very relaxed to the parent.

DETAILED DESCRIPTION OF THE PREFERRED EMBODIMENT

Reference is now made according to the attached views.

Figure 1:
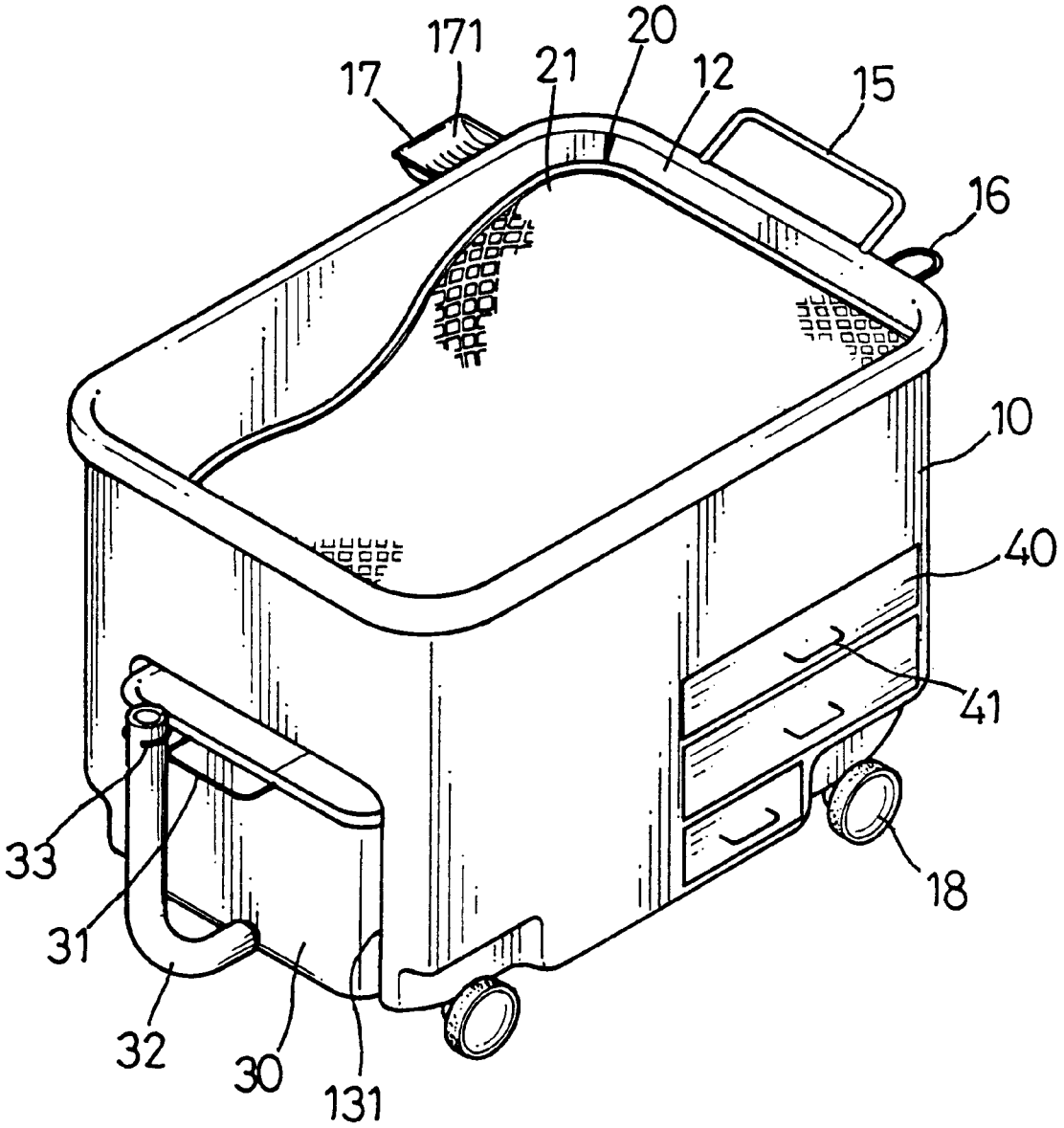
FIG. 1 is a perspective view of the invention.
Figure 2:
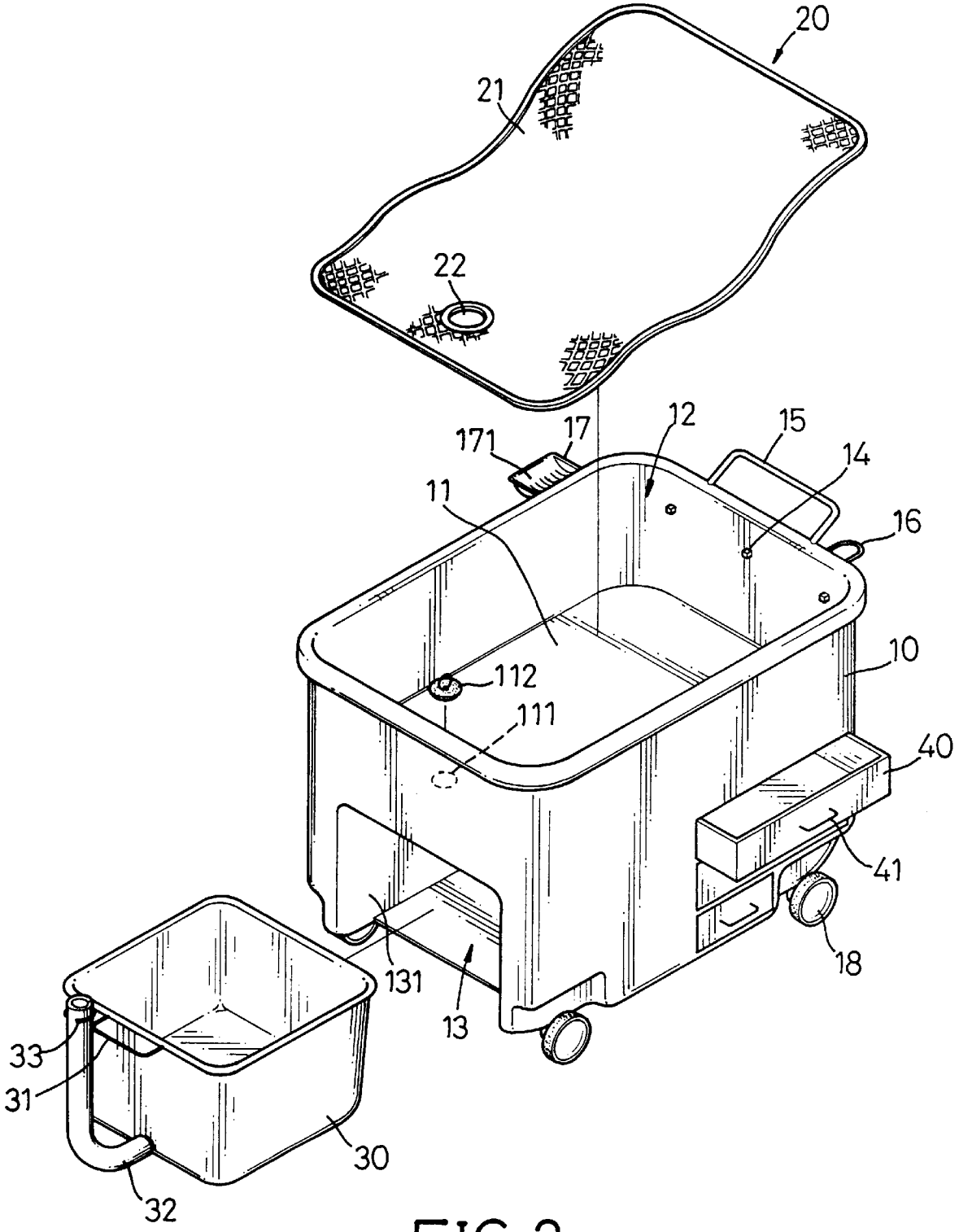
FIG. 2 is a partially exploded view of the invention.
Figure 3:
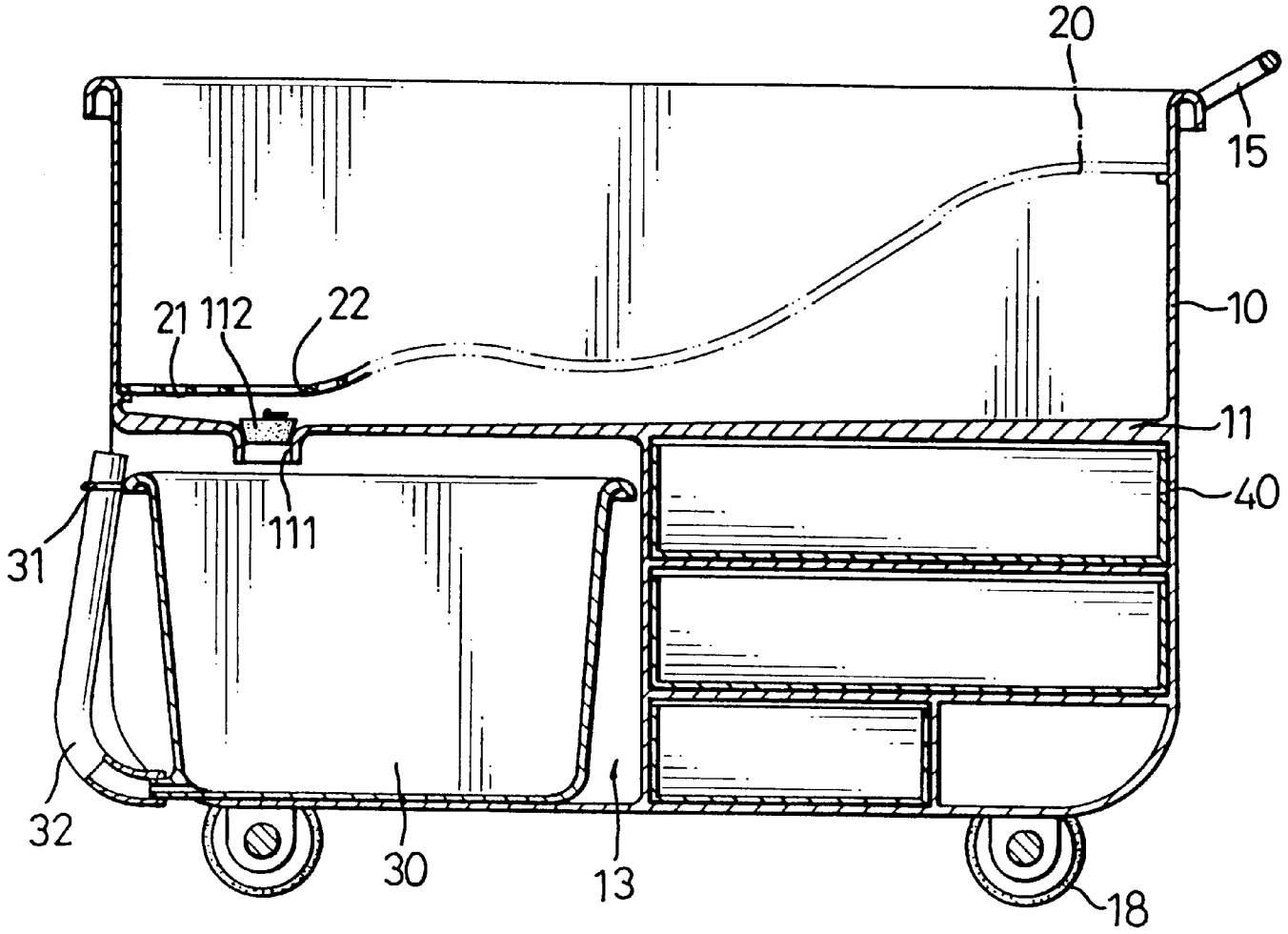
FIG. 3 is a partially cross-sectional view of the invention.

Referring to FIGS. 1, 2 and 3, the movable bathtub of the invention comprises a body (10), which is formed as a rectangular parallelepiped, and a plurality of wheels (18) which are fitted on the bottom of the body (10) to move the bathtub. The body (10) is separated into two parts by a separator (11). One is a bathing space (12) in the upper part, the other is a storage space (13) in the lower part. A tub drain (111) is defined in the separator (11). A tub stopper (112) is provided to plug the tub drain (111). The bathing space (12) has a ledge (14), for example formed as a shape of a separator as shown in FIG. 2, at the peripheral portion thereof. The ledge (14) has two opposite walls, whose heights are not equal in order to support a curve-shaped supporting net (20), in a longitude direction. The body (10) also has a handle (15) on one back outside surface thereof, an annulus (16) beside the handle (15), and a soap dish (17) on one outside surface thereof. The soap dish (17) is formed with non-slip ripples (171) on the upper surface of the bottom thereof.

The supporting net (20) formed as a curve shape has a mesh (21) in the surface thereof and a hole (22) is defined in one end thereof. A trough (131) in which a water-pot (30) may be placed is formed on one front end of the storage space (13). The water-pot (30) has a handle (31) at the periphery thereof to remove the water-pot (30), a sink drain (32) at the bottom thereof, and a drain fitting (33) beside the handle (31) for fitting a distal end of the sink drain (32). When draining water, the sink drain (32) is taken off from the drain fitting (33). In the back end of the storage space (13), several drawers (40) with handles (41) are formed.

Figure 4:
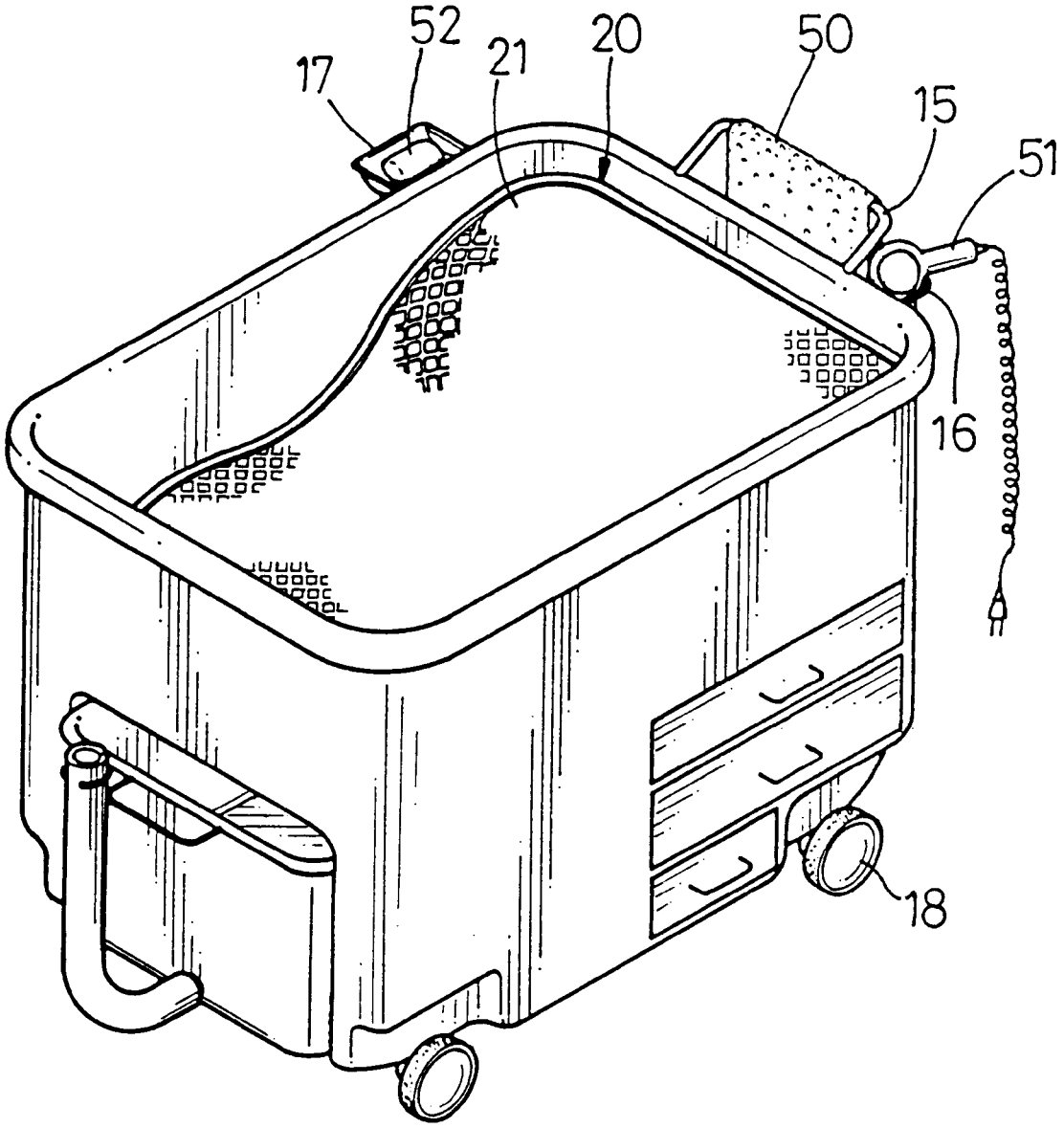
FIG. 4 is a schematic view of an embodiment of the invention.
Figure 5:
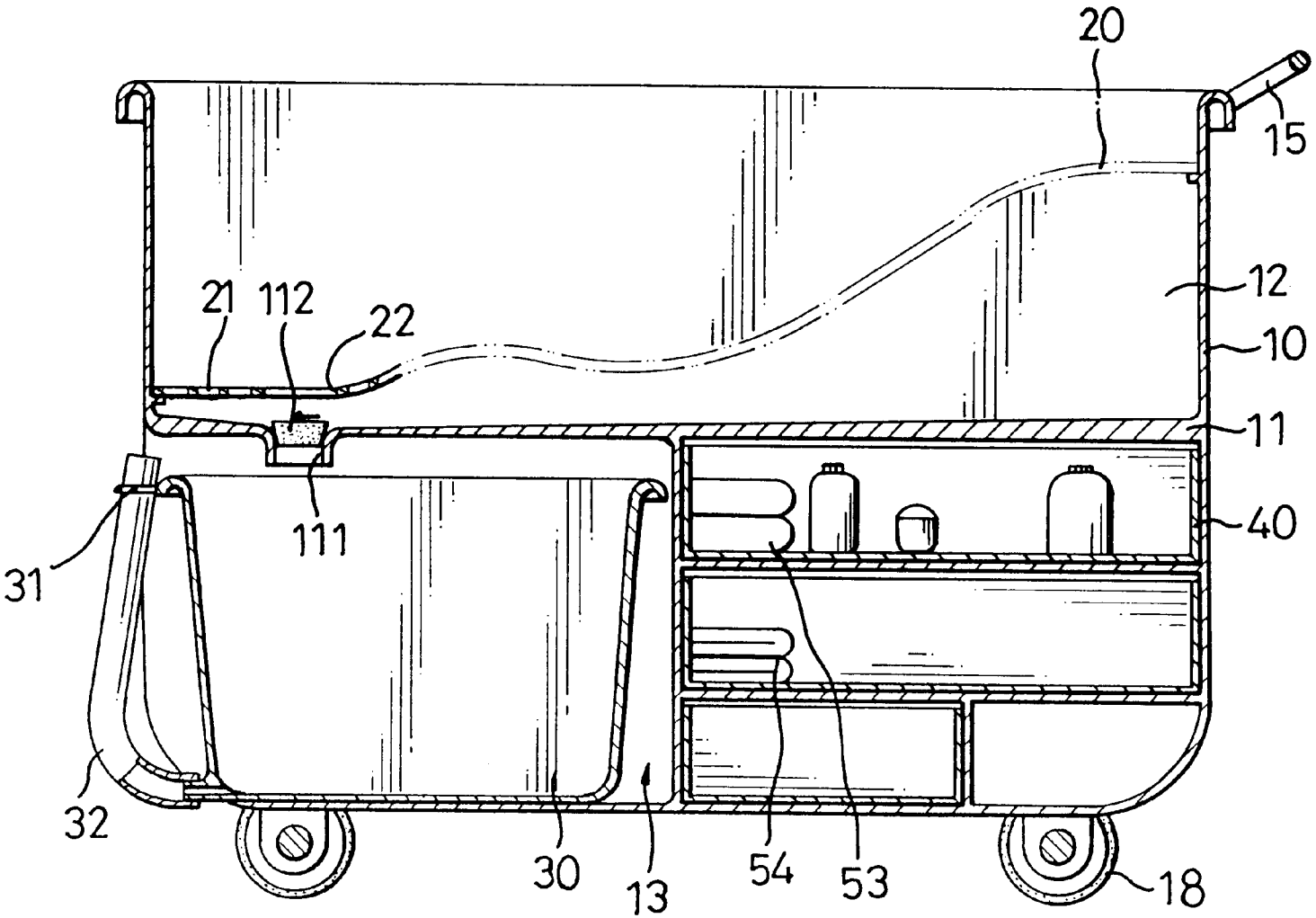
FIG. 5 is a schematically cross-sectional view showing an embodiment of the invention.
Figure 6:
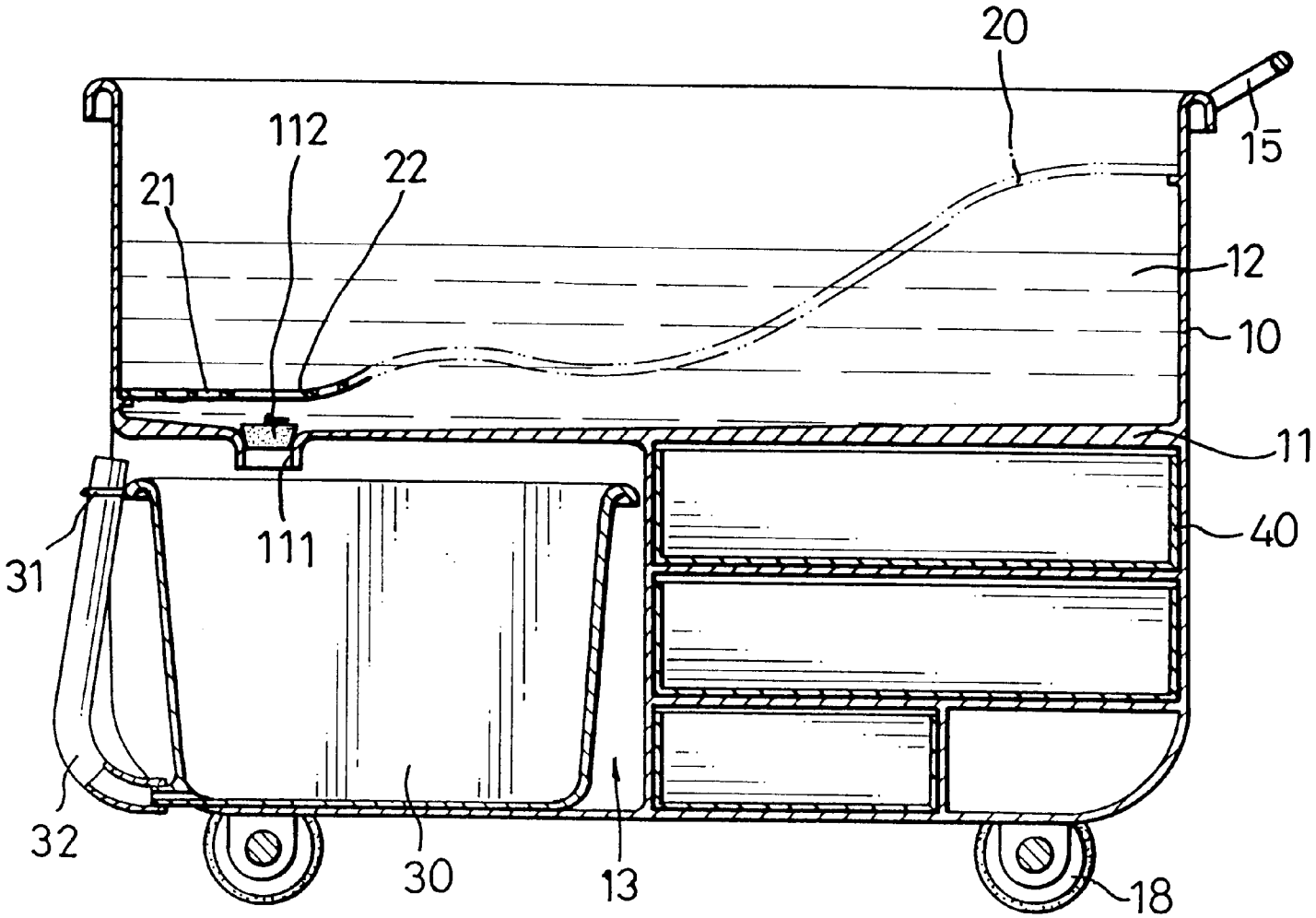
FIG. 6 is a schematically cross-sectional view of an embodiment of the invention.

Referring now to FIGS. 4 and 5, when bathing, the bathing necessities are placed in the appropriate locations of the body (10). For example, a towel (50) is hung on the handle (15), a blower (51) is inserted into the annulus (16), a bar of soap (52) is placed on the soap dish (17), and clothes (53), diapers (54), and other objects are placed in the drawers (40). The supporting net (20) is placed on the ledge (14) of the body (10). The hole (22) defined in the supporting net (20) is aligned with the tub drain (111) defined in the separator (11) so that the tub stopper (112) can be moved via the hole (22) when necessary. Then the bathtub is moved into a bathroom and heated water is poured into the bathing space (12), as shown in FIG. 6. After enough heated water is placed in the tub, the bathtub is moved to a bedroom. A baby is placed on the supporting net (20) to be bathed.

Figure 7:
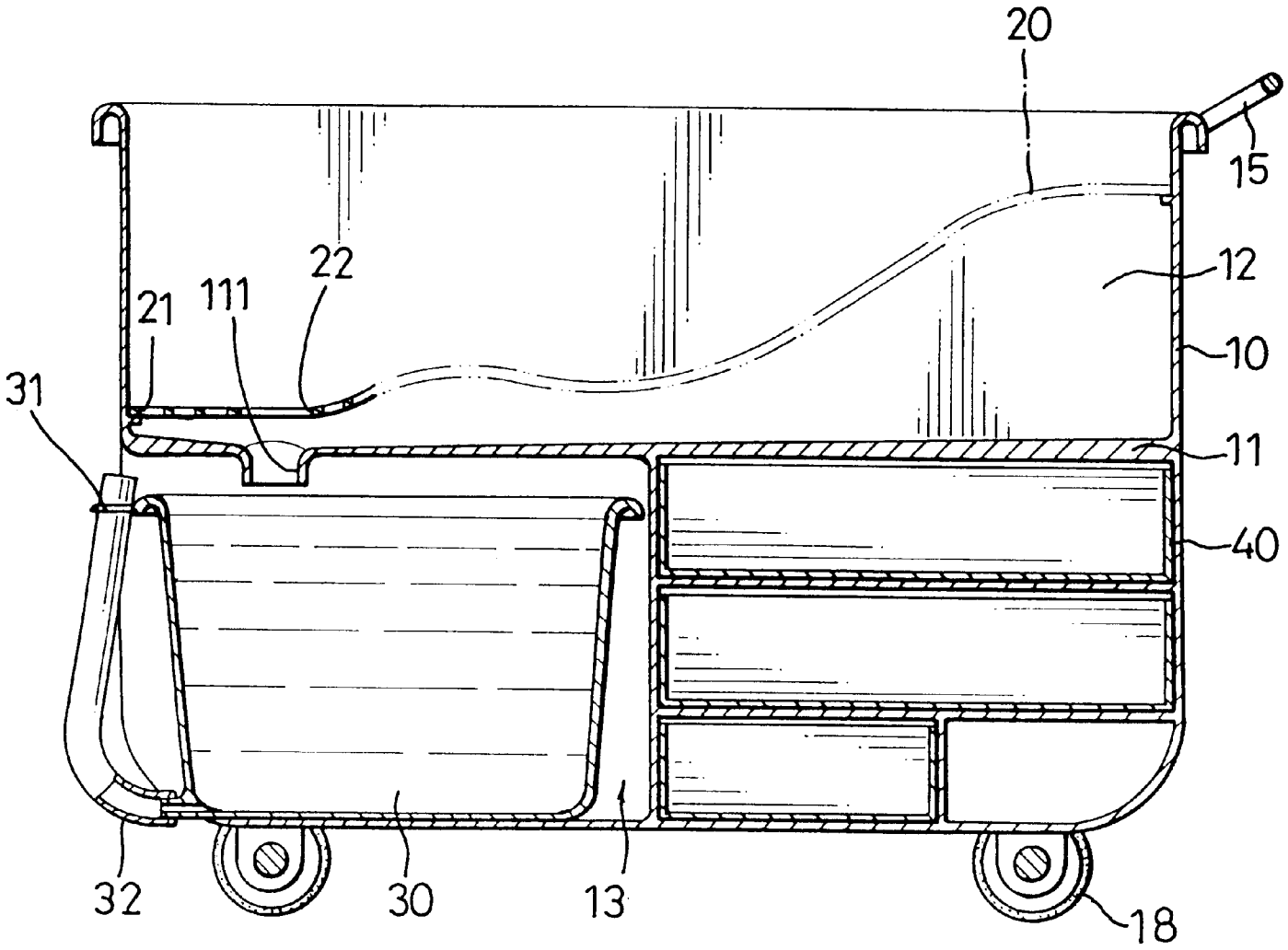
FIGS. 7 and 8 are schematically cross-sectional views of an embodiment of the invention.

After bathing, the tub stopper (112) is removed via the hole (22) to allow the heated water in the bathing space to drain into the water-pot (30), as shown in FIG. 7. Thus, the supporting net (20) is no longer submerged in the water. The baby may be dried and dressed on the supporting net (20).

Figure 8:
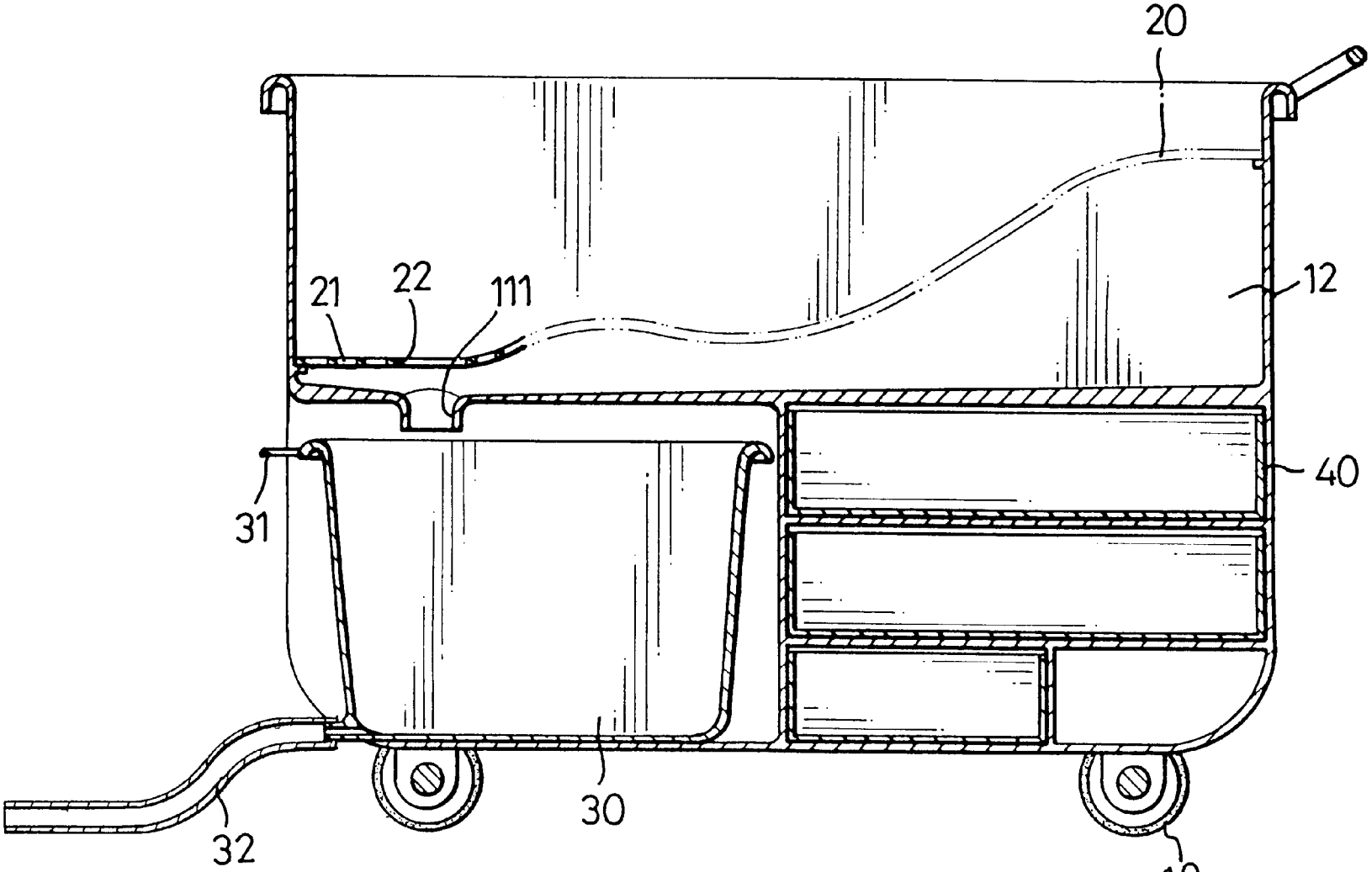

In order to drain the water from the water-pot (30), the bathtub is moved to the bathroom and the sink drain (32) is taken off, as shown in FIG. 8.

From the foregoing, it is seen that the operation is very relaxed to the parent in the entire process. Compared with the prior art, the invention has following advantages:

The main advantage is that the process of bathing is very simple. The heated water is poured in or drained out of the bathtub by moving the body of the bathtub, which is very easy to the parent. In the meanwhile, the heated water is prevented from spilling onto the floor.

A second advantage is that the invention provides specific positions to hold the bathing necessities. Thus, when bathing, the necessities can be located orderly and conveniently.

Another advantage is that the invention may protect the baby from catching a cold. The baby is bathed and dressed on the supporting net. The temperature in the bathing space can prevent the baby from catching a cold. After dressing, the baby can also rest on it.

Yet, another advantage is that the invention allows the parent to stand while bathing the baby. The bathtub is tall enough for the parent to stand while bathing the baby. Standing keeps the parent from squatting down and from feeling unwell.

Therefore, the invention introduces a practical structure for a movable bathtub for a baby.

What is claimed is:

1. A movable bathtub for a baby comprising:

a body having a separator by which the body is separated into a bathing space and a storage space;

a tub drain defined in the separator;

a tub stopper releasably connected with the tub drain;

a curve-shaped supporting net placed in the bathing space;

a hole through said supporting net is substantial alignment with said tub drain for accessing said tub stopper;

a water-pot placed in a trough in the storage space and corresponding with the tub drain; and a plurality of wheels rotatably fitted to the bottom of the body.

2. The movable bathtub of claim 1 wherein the bathing space is formed with a ledge on the periphery thereof to locate the supporting net.

3. The movable bathtub of claim 1 wherein the storage space is provided with several drawers on one end thereof.

4. The movable bathtub of claim 1 wherein the body is formed with a handle on a side thereof.

5. The movable bathtub of claim 1 wherein the body is formed with a trough beside the handle.

6. The movable bathtub of claim 1 wherein the body is formed with a soap dish on a side thereof.

7. The movable bathtub of claim 1 wherein a handle is formed on the periphery of the water-pot.

8. The movable bathtub of claim 1 wherein the water-pot is provided with a sink drain on the bottom thereof and a drain fitting on an upper end thereof.

* * * * *